US010685602B2

(12) United States Patent
Chen et al.

(10) Patent No.: US 10,685,602 B2
(45) Date of Patent: Jun. 16, 2020

(54) ORGANIC LIGHT EMITTING DIODE PIXEL DRIVING CIRCUIT AND DISPLAY APPARATUS OF SAME

(71) Applicant: Shenzhen China Star Optoelectronics Semiconductor Display Technology Co., Ltd., Shenzhen (CN)

(72) Inventors: Xiaolong Chen, Shenzhen (CN); Yi-chien Wen, Shenzhen (CN); Mingjong Jou, Shenzhen (CN)

(73) Assignee: Shenzhen China Star Optoelectronics Semiconductor Display Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/331,153

(22) PCT Filed: Sep. 10, 2018

(86) PCT No.: PCT/CN2018/104746
§ 371 (c)(1),
(2) Date: Mar. 7, 2019

(87) PCT Pub. No.: WO2020/015088
PCT Pub. Date: Jan. 23, 2020

(65) Prior Publication Data
US 2020/0135094 A1 Apr. 30, 2020

(30) Foreign Application Priority Data
Jul. 20, 2018 (CN) ..... 2018 1 0802426

(51) Int. Cl.
*G09G 3/3258* (2016.01)
*G09G 3/3275* (2016.01)
*G09G 3/325* (2016.01)
*G09G 3/3266* (2016.01)

(52) U.S. Cl.
CPC ..... *G09G 3/325* (2013.01); *G09G 3/3258* (2013.01); *G09G 3/3266* (2013.01); *G09G 2300/0842* (2013.01); *G09G 2320/0233* (2013.01)

(58) Field of Classification Search
CPC combination set(s) only.
See application file for complete search history.

(56) References Cited

U.S. PATENT DOCUMENTS

2011/0122119 A1* 5/2011 Bae ..... G09G 3/3233 345/211
2013/0127692 A1* 5/2013 Yoon ..... G09G 3/3258 345/80
2020/0020278 A1* 1/2020 Lee ..... G09G 3/3275

* cited by examiner

*Primary Examiner* — Deeprose Subedi

(57) ABSTRACT

The present disclosure provides an OLED pixel driving circuit and an OLED display apparatus utilizing the circuit scheme of 3T1C. The normal displaying mode and detecting mode of the pixel driving circuit both include two phases by controlling the conductions of different transistors. And, the pixel driving circuit is capable of implementing corresponding data compensation under the displaying mode according to the detected voltage threshold Vth of the driving TFT and the intrinsic conductivity factor value k of the aged OLED. This is capable of improving the uniformity of display and the illuminating efficiency.

20 Claims, 5 Drawing Sheets

ORGANIC LIGHT EMITTING DIODE PIXEL DRIVING CIRCUIT AND DISPLAY APPARATUS OF SAME

RELATED APPLICATIONS

This application is a National Phase of PCT Patent Application No. PCT/CN2018/104746 having International filing date of Sep. 10, 2018, which claims the benefit of priority of Chinese Patent Application No. 201810802426.7 filed on Jul. 20, 2018. The contents of the above applications are all incorporated by reference as if fully set forth herein in their entirety.

FIELD AND BACKGROUND OF THE INVENTION

The present disclosure relates to the field of display technologies, and more particularly to an organic light emitting diode (OLED) pixel driving circuit and an OLED display apparatus.

In recentyears, display technologies of organic light emitting diode (OLED) develop rapidly to promote the curve and flexible touch display products to market quickly, and the technologies of relevant field are innovated from day to day. OLED is a diode capable of emitting light by utilizing organic semiconductor material and electroluminescent material for injecting and incorporating charge carriers under the excitation of electrical field. OLED display apparatus has the advantages of self-illuminating, low driving voltage, high illuminating efficiency, short response time, high sharpness and contrast ratio, wide viewing angle with nearly 180 degrees, wide range of operation temperature, flexible display capability and big area display with full colors. OLED display apparatus is commonly considered as a kind of display apparatus with most development prospect.

OLED is a component which is driven by current. OLED illuminates while current flows across, and the illuminance depends on the current volume flowed across the OLED. Most existed integrated circuits (ICs) only transmit voltage signals; thus a pixel driving circuit is needed to implement a task of converting voltage signals into current signals. The conventional OLED pixel driving circuit usually uses a circuit scheme with two transistors and one capacitance (2T1C) to convert voltage signals into current signals.

Referring to FIG. 1, FIG. 1 is a schematic view of a conventional 2T1C pixel driving circuit for the OLED. As shown in FIG. 1, the conventional 2T1C pixel driving circuit for the OLED includes a first thin film transistor (TFT) T1, a second TFT T2 and a capacitor Cs, wherein the first TFT T1 is a driving TFT, the second TFT T2 is a switch TFT, the capacitor Cs is a storage capacitor. Specifically, a source of the first TFT T1 is electrically connected to an anode of an OLED D0, a drain of the first TFT T1 is connected to a power voltage OVDD, and a gate of the first TFT T1 is connected to a first node G. A cathode of the OLDE D0 is connected to a common ground OVSS. A source of the second TFT T2 is electrically connected to the first node G, a gate of the second TFT T2 connects with a scan signal Scan, and a drain of the second TFT T2 is connected to a data signal Data. The capacitor Cs has one end connecting with the gate of the first TFT T1, and another end electrically connecting with the source of the first TFT T1. While the OLED is displaying, the scan signal controls the second TFT T2 in on state, and the data signal is transmitted through the second TFT T2 into the gate of the first TFT T1 and the capacitor Cs, and then the second TFT T2 is controlled in off state, the voltage of gate of the first TFT T1 is still with the data signal voltage because charges are stored in the capacitor Cs. Subsequently, the first TFT is controlled in on state, a driving current flows through the OLED D0 to drive the OLED D0 to illuminate.

The I-V equation of transistor:

$$I_{ds,sat}=k\cdot(V_{GS}-V_{th,T1})^2=k\cdot(V_G-V_S-V_{th,T1})^2$$

in the equation, k is an intrinsic conductivity factor value, $I_{ds,sat}$ value is related to a voltage threshold of the driving TFT, that is, the TFT T1.

As a result of the uncontrollable factors during the manufacturing processes of the panel, the voltage threshold $V_{th}$ of the driving TFT of each sub-pixel in the panel may different. Consequently, the currents flowed into each OLED may not be identical, even the voltage Vdata of data signal Data is input to each driving TFT of sub-pixel uniformly. This is the reason that the uniformity of image display quality is difficult to realize.

Additionally, as the accumulation of driving time of the driving TFT, the material of TFT may age and degenerate; this makes the voltage threshold $V_{th}$ of the driving TFT drift. Moreover, as the aged conditions of material of each TFT may different, this results in the different drift of voltage threshold $V_{th}$ of each driving TFT and also results in the non-uniform display quality of panel. Further, the aged condition of TFT material becomes more serious as the continuous accumulation of driving time of the driving TFT. The currents flowed across each OLED may not be identical, even the driving voltage is same; this causes the non-uniform illuminance of OLED. Moreover, the start voltage of OLED will increase due to the aging of OLED, and the current flowed into OLED will get smaller gradually; this brings the problems of degrading illuminance and illuminating efficiency of panel.

Referring to FIG. 2, FIG. 2 is a schematic view of a conventional 3T1C (three transistors, one capacitor) pixel driving circuit for the OLED. As shown in FIG. 2, the conventional 3T1C pixel driving circuit for the OLED includes a first TFT T1, a second TFT T2, a third TFT T3, a capacitor CLED and a capacitor Cp, wherein the first TFT T1 is a driving TFT. Comparing with the 2T1C pixel driving circuit shown in FIG. 1, the conventional 3T1C pixel driving circuit supplements following components: the CLED electrically connected between the anode and the cathode of LED D0; the third TFT T3 has a source electrically connected to a source of the first TFT T1, a drain connected to a sensing control signal Sense and a gate connected to a scan signal Scan; a capacitor Cp has one end connected to the drain of the third TFT T3 and another end connected to a common ground; a reference voltage Vref connects with the sensing control signal Sense; and an analog to digital converter ADC0 connects with the sensing control signal Sense through a switch SW0. The conventional 3T1C pixel driving circuit compensates the voltage threshold $V_{th}$ of the driving TFT T1 by detecting the voltage threshold $V_{th}$ of the driving TFT T1; however, such design is only capable of compensating the voltage threshold $V_{th}$, but unable to compensate the effect of aging for the OLED. The k value will drift when the OLED is aged, and the aged conditions of material of each TFT may differ; this results in the problems for degradation of illuminance, reduction of illuminating efficiency and non-uniformity of illuminance of panel.

Therefore, the technical problems of compensating the drift of the voltage threshold $V_{th}$ of the driving TFT and the drift of k value in the aged OLED, and improving the uniformity of illuminance of OLED panel are needed to be resolved.

SUMMARY OF THE INVENTION

An objective of the present disclosure is to provide an organic light emitting diode (OLED) pixel driving circuit and an OLED display apparatus capable of compensating the drift of the voltage threshold $V_{th}$ of the driving TFT and the drift of k value in the aged OLED, and improving the uniformity of illuminance of OLED panel.

In order to achieve the above objective, the present disclosure provides an OLED pixel driving circuit which has an operating status including a displaying mode and a detecting mode. The driving circuit includes: a first thin film transistor having a gate electrically connected to a first node, a source electrically connected to a second node, a drain simultaneously electrically connected to a data current through a first transistor and electrically connected to a power voltage through a second transistor; a second thin film transistor having a gate electrically connected to a scan signal, a source electrically connected to the first node, a drain respectively electrically connected to a data signal, electrically connected to a data voltage through a fifth transistor during the displaying mode and to a initializing voltage through the fifth transistor during the detecting mode, and electrically connected to a first analog to digital converter (ADC) through a sixth transistor; a third thin film transistor having a gate electrically connected to the scan signal, a source electrically connected to the second node, a drain simultaneously electrically connected to a reference voltage through a third transistor and a second ADC through a fourth transistor; a capacitor having one end electrically connected to the first node, and the other end electrically connected to the second node; an OLED having an anode electrically connected to the second node, and a cathode electrically connected to a common ground. The first to sixth transistors, the first and second ADCs are disposed in a driver chip.

The displaying mode includes a data writing phase and an illuminating phase. During the data writing phase of the displaying mode: the scan signal is in a high voltage level so as to enable the conductions of the second thin film transistor and the third thin film transistor, the second transistor, the fifth transistor and the third transistor are conducted under control by the corresponding voltage level control signals, the first node is written with the data voltage through the second thin film transistor and the fifth transistor, the second node is written with the reference voltage through the third thin film transistor and the third transistor. During the illuminating phase of the displaying mode: the scan signal is in a low voltage level so as to disable the conductions of the second thin film transistor and the third thin film transistor, the charges stored in the capacitor are attributed to a difference between the data voltage and the reference voltage, and the OLED illuminates.

The detecting mode includes a voltage level initializing phase and a detecting phase. During the voltage level initializing phase of the detecting mode: the scan signal is in the high voltage level so as to enable the conductions of the second thin film transistor and the third thin film transistor, the fifth transistor and the third transistor are conducted under control by the corresponding voltage level control signals, the first node is written with the initializing voltage through the second thin film transistor and the fifth transistor, the second node is written with the reference voltage through the third thin film transistor and the third transistor. During the detecting phase of the detecting mode: the scan signal is in the high voltage level, the fifth transistor and the third transistor are cut off under control by the corresponding voltage level control signals, the first transistor, the sixth transistor and the fourth transistor are conducted under control by the corresponding voltage level control signals, the second node is charged and discharged by inputting different values of the data current through the first thin film transistor, the first ADC detects a voltage level of the first node through the second thin film transistor and the sixth transistor after the data current is stabilized, the second ADC detects a voltage level of the second node through the third thin film transistor and the fourth transistor, whereby a voltage threshold of the first thin film transistor and an intrinsic conductivity factor value are detected.

In order to achieve the above objective, the present further disclosure provides an OLED pixel driving circuit. The operating status of the driving circuit includes a displaying mode and a detecting mode. The driving circuit includes: a first thin film transistor having a gate electrically connected to a first node, a source electrically connected to a second node, a drain simultaneously electrically connected to a data current through a first transistor and electrically connected to a power voltage through a second transistor; a second thin film transistor having a gate electrically connected to a scan signal, a source electrically connected to the first node, a drain respectively electrically connected to a data signal, electrically connected to a data voltage through a fifth transistor during the displaying mode and to a initializing voltage through the fifth transistor during the detecting mode, and electrically connected to a first ADC through a sixth transistor; a third thin film transistor having a gate electrically connected to the scan signal, a source electrically connected to the second node, a drain simultaneously electrically connected to a reference voltage through a third transistor and a second ADC through a fourth transistor; a capacitor having one end electrically connected to the first node, and the other end electrically connected to the second node; an OLED having an anode electrically connected to the second node, and a cathode electrically connected to a common ground.

During the displaying mode, the second transistor, the fifth transistor and the third transistor are conducted under control by the corresponding voltage level control signals. The displaying mode includes a data writing phase and an illuminating phase. The scan signal is in a high voltage level during the data writing phase so as to enable the conductions of the second thin film transistor and the third thin film transistor. The data voltage and the reference voltage are input into the driving circuit, the scan signal is in a low voltage level during the illuminating phase so as to disable the conductions of the second thin film transistor and the third thin film transistor, the charges stored in the capacitor illuminate the OLED.

During the detecting mode, the fifth transistor and the third transistor are conducted under control by the corresponding voltage level control signals in the first, and then the fifth transistor and the third transistor are cut off under control by the corresponding voltage level control signals, and, the first transistor, the sixth transistor and the fourth transistor are conducted under control by the corresponding voltage level control signals. The detecting mode includes a voltage level initializing phase and a detecting phase, the scan signal is always in the high voltage level, the second thin film transistor and the third thin film transistor are conducted during the voltage level initializing phase, the initializing voltage and the reference voltage are input into the driving circuit. The data current is input into the driving circuit during the detecting mode, the first ADC and the second ADC detect a voltage threshold of the first thin film transistor and an intrinsic conductivity factor value by inputting different values of the data current.

In order to achieve the above objective, the present further disclosure provides an OLED display apparatus including an OLED pixel driving circuit. The operating status of the driving circuit includes a displaying mode and a detecting mode. The driving circuit includes: a first thin film transistor having a gate electrically connected to a first node, a source electrically connected to a second node, a drain simultaneously electrically connected to a data current through a first transistor and electrically connected to a power voltage through a second transistor; a second thin film transistor having a gate electrically connected to a scan signal, a source electrically connected to the first node, a drain respectively electrically connected to a data signal, electrically connected to a data voltage through a fifth transistor during the displaying mode and to a initializing voltage through the fifth transistor during the detecting mode, and electrically connected to a first analog to digital converter (ADC) through a sixth transistor; a third thin film transistor having a gate electrically connected to the scan signal, a source electrically connected to the second node, a drain simultaneously electrically connected to a reference voltage through a third transistor and a second ADC through a fourth transistor; a capacitor having one end electrically connected to the first node, and the other end electrically connected to the second node; an OLED having an anode electrically connected to the second node, and a cathode electrically connected to a common ground. The first to sixth transistors, the first and second ADCs are disposed in a driver chip.

The displaying mode includes a data writing phase and an illuminating phase. During the data writing phase of the displaying mode: the scan signal is in a high voltage level so as to enable the conductions of the second thin film transistor and the third thin film transistor, the second transistor, the fifth transistor and the third transistor are conducted under control by the corresponding voltage level control signals, the first node is written with the data voltage through the second thin film transistor and the fifth transistor, the second node is written with the reference voltage through the third thin film transistor and the third transistor. During the illuminating phase of the displaying mode: the scan signal is in a low voltage level so as to disable the conductions of the second thin film transistor and the third thin film transistor, the charges stored in the capacitor are attributed to a difference between the data voltage and the reference voltage, the OLED illuminates.

The detecting mode includes a voltage level initializing phase and a detecting phase. During the voltage level initializing phase of the detecting mode: the scan signal is in the high voltage level so as to enable the conductions of the second thin film transistor and the third thin film transistor, the fifth transistor and the third transistor are conducted under control by the corresponding voltage level control signals, the first node is written with the initializing voltage through the second thin film transistor and the fifth transistor, the second node is written with the reference voltage through the third thin film transistor and the third transistor. During the detecting phase of the detecting mode: the scan signal is in the high voltage level, the fifth transistor and the third transistor are cut off under control by the corresponding voltage level control signals, the first transistor, the sixth transistor and the fourth transistor are conducted under control by the corresponding voltage level control signals, the second node is charged and discharged by inputting different values of the data current through the first thin film transistor, the first ADC detects a voltage level of the first node through the second thin film transistor and the sixth transistor after the data current is stabilized, the second ADC detects a voltage level of the second node through the third thin film transistor and the fourth transistor, whereby a voltage threshold of the first thin film transistor and an intrinsic conductivity factor value are detected.

The present disclosure has the following advantages. The OLED pixel driving circuit and the OLED display apparatus of the present disclosure use the circuit scheme of 3T1C. The normal displaying mode and detecting mode of the pixel driving circuit both include two phases by controlling the conductions of different transistors. And, the pixel driving circuit is capable of implementing corresponding data compensation under the displaying mode according to the detected voltage threshold Vth of the driving TFT and the intrinsic conductivity factor value k of the aged OLED, for improving the uniformity of illuminance of OLED panel and the illuminating efficiency.

BRIEF DESCRIPTION OF THE SEVERAL VIEWS OF THE DRAWINGS

In order to illustrate the technical solutions of the embodiments of the present disclosure more clearly, following detailed description and drawings with reference to the exemplary embodiments of the present disclosure are concisely described below. Apparently, the specific embodiments described herein are only some examples of the present disclosure. Based on the following drawings, person who skilled in the art may obtain further drawings without making inventive effort.

DESCRIPTION OF SPECIFIC EMBODIMENTS OF THE INVENTION

Following detailed description and drawings with reference to the exemplary embodiments of the present disclosure are described below in further detail, in which a same reference number or a similar reference number denotes a same element or a similar element, or an element with same or similar function. The specific embodiments described herein referred to drawings are exemplary examples, only used for explaining the present disclosure, it should not be considered to the limit of the present invention.

Unless a definite rule or limitation exists, in the present disclosure, a first feature is “above” or “under” a second feature means that it may include a condition of the first feature directly adjacent to the second feature, and may include a condition of the first feature not directly adjacent to the second feature but through further feature. In addition, a first feature is "above", "upon" and "upside" a second feature means that it may include conditions of the first feature right above or slantingly above the second feature, or it only means that a horizontal level of the first feature is higher than the second feature. A first feature is "under", "below" and "downside" a second feature means that it may include conditions of the first feature right under or slantingly under the second feature, or it only means that a horizontal level of the first feature is lower than the second feature.

Following disclosure provides several various embodiments or examples for realizing the different structures of the present disclosure. In order to simplify the illustration of the present disclosure, following descriptions depict the elements and dispositions of specific examples. Surely, the examples are only for exemplifying and the purpose is not to limit the present invention. In addition, the reference numbers or reference symbols may be iterated in different examples of the present disclosure, the reiterations render the purposes of simplification and clearness, and the reiterations do not indicate the relations among every embodiment and/or disposition which are depicted. Furthermore, the present disclosure provides every example of specific arts and materials, but those skilled in the art may be aware of the implementation for the application of other arts or the utilization of other materials.

Figure 1:
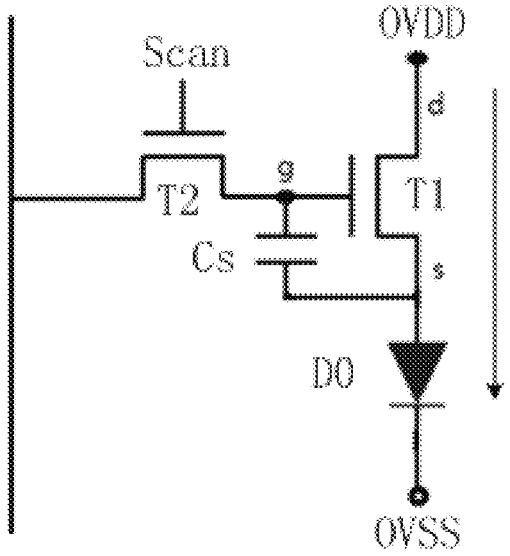
FIG. 1 is a schematic view of a conventional 2T1C pixel driving circuit for an OLED.
Figure 2:
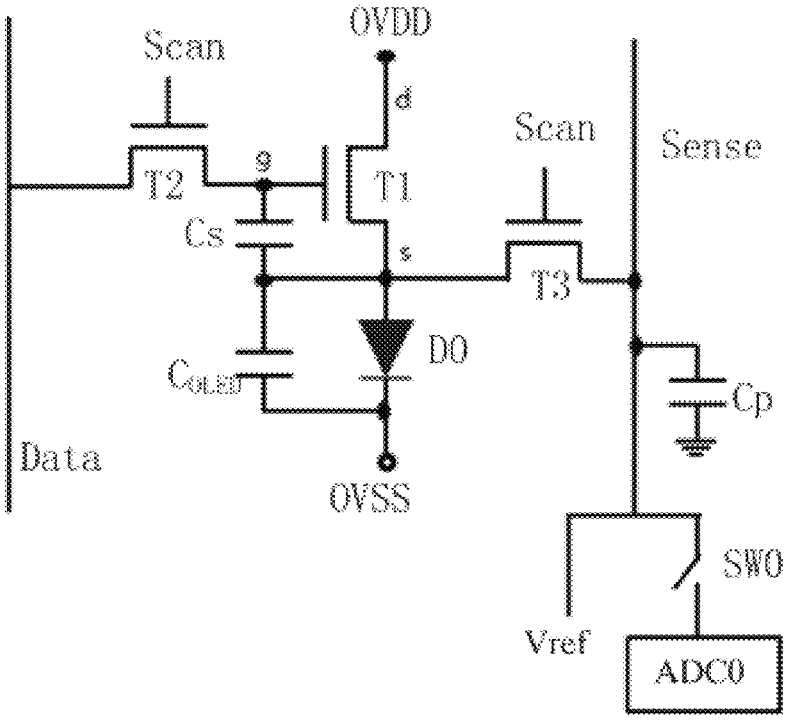
FIG. 2 is a schematic view of a conventional 3T1C pixel driving circuit for an OLED.
Figure 3:
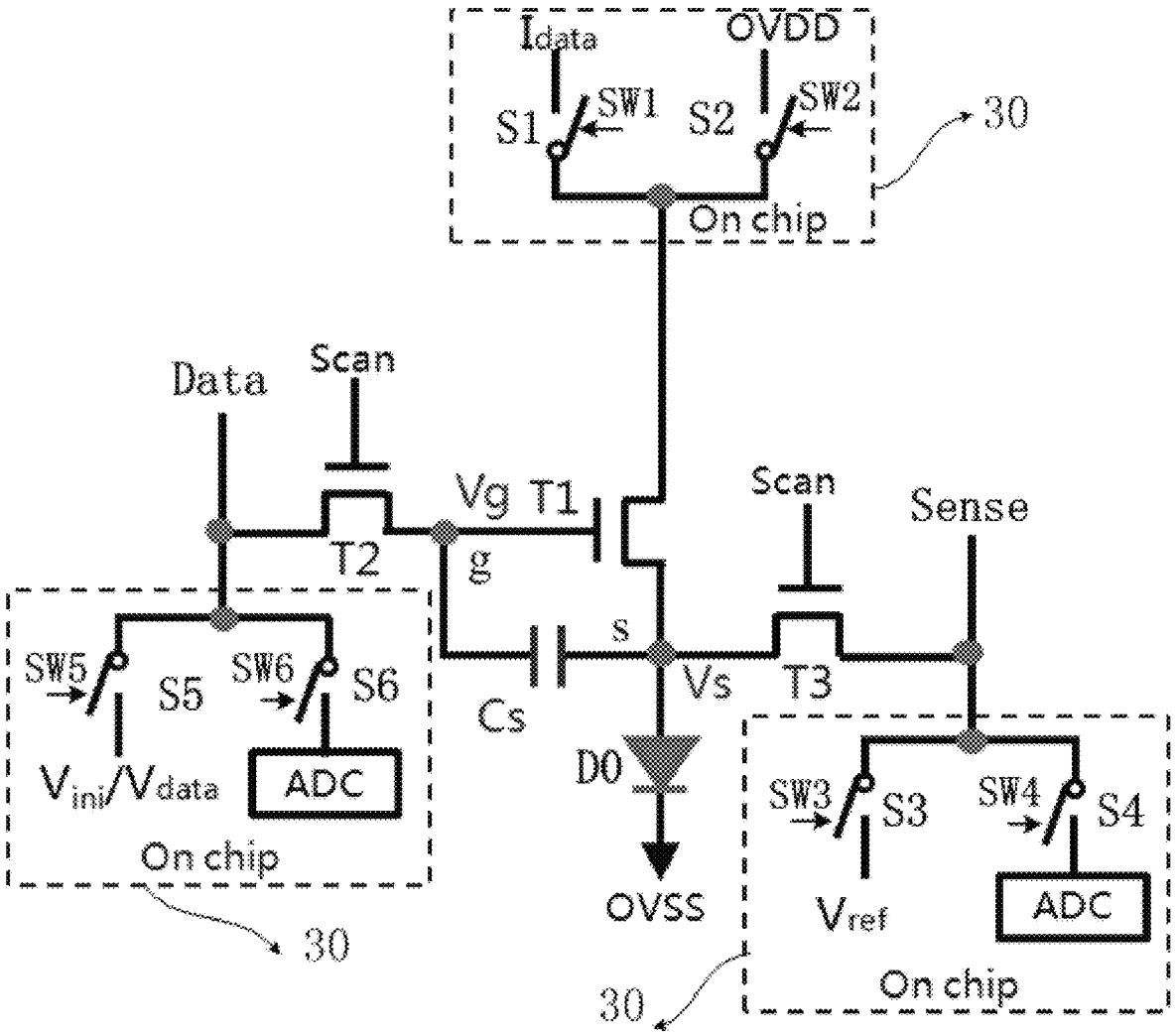
FIG. 3 is a schematic view of a first embodiment of an OLED pixel driving circuit of the present disclosure.
Figure 4:
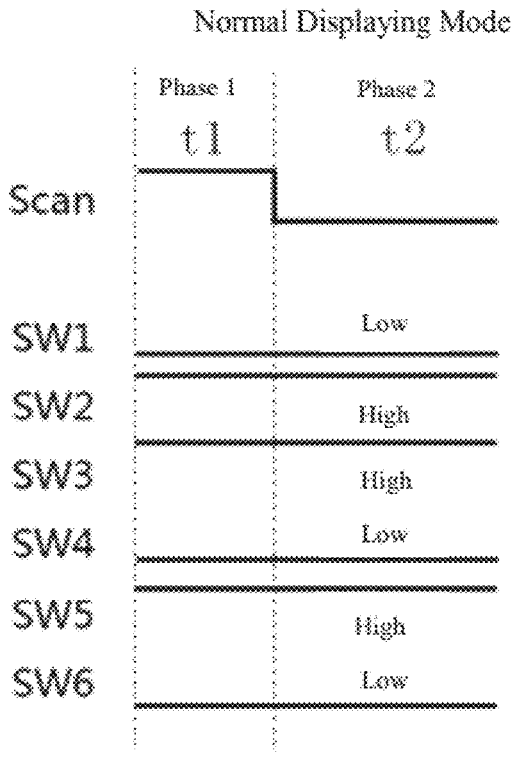
FIG. 4 is a timing diagram of a displaying mode of the OLED pixel driving circuit shown in FIG. 3.
Figure 5:
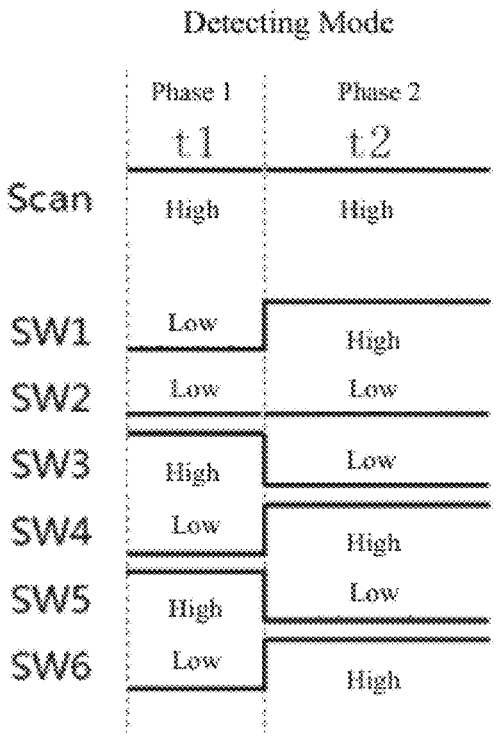
FIG. 5 is a timing diagram of a detecting mode of the OLED pixel driving circuit shown in FIG. 3.

Referring to FIGS. 3 to 5, FIG. 3 shows a schematic view of a first embodiment of an OLED pixel driving circuit of the present disclosure, FIG. 4 shows a timing diagram of a displaying mode of the OLED pixel driving circuit shown in FIG. 3, FIG. 5 shows a timing diagram of a detecting mode of the OLED pixel driving circuit shown in FIG. 3. The driving circuit includes: first to third thin film transistors (TFT) T1-T3, first and sixth transistors S1-S6, a capacitor Cs, an OLED D0, and first and second analog to digital converters (ADC) ADC1, ADC2. The operating status of the driving circuit includes a displaying mode and a detecting mode.

In the first embodiment of the present disclosure, the first and sixth transistors S1-S6, the first ADC ADC 1 and the second ADC ADC2 are disposed in a driving integrated circuit (IC) 30, for improving the integration of the circuit. In other embodiments, above-mentioned components can be also disposed on a panel directly.

The first TFT T1 has a gate electrically connected to a first node g, a source electrically connected a second node s, a drain simultaneously electrically connected to a data current Idata through the first transistor S1 and electrically connected to a power voltage OVDD through a second transistor S2. The TFT T1 is a driving TFT used for driving the OLED D0.

The second TFT T2 has a gate electrically connected to a scan signal Scan, a source electrically connected to the first node g, a drain respectively electrically connected to a data signal Data, electrically connected to a data voltage Vdata through the fifth transistor S5 during the displaying mode and to a initializing voltage Vini through the fifth transistor S5 during the detecting mode, and electrically connected to the first ADC ADC1 through the sixth transistor S6.

The third thin film transistor has a gate electrically connected to the scan signal Scan, a source electrically connected to the second node s, a drain simultaneously electrically connected to a reference voltage Vref through the third transistor S3 and the second ADC ADC2 through the fourth transistor S4.

The capacitor Cs has one end electrically connected to the first node g, and the other end electrically connected to the second node s.

The OLED D0 has an anode electrically connected to the second node s, and a cathode electrically connected to a common ground OVSS.

During the displaying mode, the second transistor S2, the fifth transistor and S5 the third transistor S3 are conducted under control by the corresponding voltage level control signals SW. The displaying mode includes a data writing phase t1 and an illuminating phase t2. The scan signal Scan is in a high voltage level during the data writing phase t1 so as to enable the conductions of the second thin film transistor T2 and the third thin film transistor T3. The data voltage Vdata and the reference voltage Vref are input into the driving circuit, the scan signal Scan is in a low voltage level during the illuminating phase t2 so as to disable the conductions of the second thin film transistor T2 and the third thin film transistor T3, the charges stored in the capacitor Cs illuminate the OLED D0.

Specifically, during the data writing phase t1 of the displaying mode: the scan signal Scan is in a high voltage level so as to enable the conductions of the second thin film transistor T2 and the third thin film transistor T3, the second transistor S2, the fifth transistor S5 and the third transistor S3 are conducted under control by the corresponding voltage level control signals SW, the first node g is written with the data voltage Vdata (written with a compensated data voltage after receiving a compensated data) through the second thin film transistor T2 and the fifth transistor S5, the second node s is written with the reference voltage Vref through the third thin film transistor T3 and the third transistor S3, the OLED not illuminates during this phase. During the illuminating phase t2 of the displaying mode: the scan signal Scan is in a low voltage level so as to disable the conductions of the second thin film transistor T2 and the third thin film transistor T3, the charges stored in the capacitor Cs are attributed to a difference between the data voltage Vdata and the reference voltage Vref (i.e., the charges stored in the capacitor Cs are the same as those stored therein in the previous phase), the OLED D0 illuminates.

During the detecting mode, the fifth transistor S5 and the third transistor S3 are conducted under control by the corresponding voltage level control signals SW in the first, and then the fifth transistor S5 and the third transistor S3 are cut off under control by the corresponding voltage level control signals SW, and, the first transistor S1, the sixth transistor S6 and the fourth transistor S4 are conducted under control by the corresponding voltage level control signals SW. The detecting mode includes a voltage level initializing phase t1 and a detecting phase t2, the scan signal Scan is always in the high voltage level, the second thin film transistor T2 and the third thin film transistor T3 are conducted during the voltage level initializing phase t1, the initializing voltage Vini and the reference voltage Vref are input into the driving circuit. The data current Idata is input into the driving circuit during the detecting mode t2, the first ADC ADC1 and the second ADC ADC2 detect a voltage threshold Vth of the first thin film transistor T1 and an intrinsic conductivity factor value k by inputting different values of the data current Idata. The corresponding data compensation can be implemented under the displaying mode according to the voltage threshold Vth of a detected driving TFT (i.e., the first thin film transistor T1) and the intrinsic conductivity factor value k.

Specifically, during the voltage level initializing phase t1 of the detecting mode: the scan signal Scan is in the high voltage level so as to enable the conductions of the second thin film transistor T2 and the third thin film transistor T3, the fifth transistor S5 and the third transistor S3 are conducted under control by the corresponding voltage level control signals SW, the first node g is written with the initializing voltage Vini through the second thin film transistor T2 and the fifth transistor S5, the second node s is written with the reference voltage Vref through the third thin film transistor T3 and the third transistor S3. During the detecting phase t2 of the detecting mode: the scan signal Scan is in the high voltage level, the fifth transistor S5 and the third transistor S3 are cut off under control by the corresponding voltage level control signals SW, the first transistor S1, the sixth transistor S6 and the fourth transistor S4 are conducted under control by the corresponding voltage level control signals SW, the second node s is charged and discharged by inputting different values of the data current Idata through the first thin film transistor T1, the first ADC ADC1 detects a voltage level of the first node g through the second thin film transistor T2 and the sixth transistor S6 after the data current is stabilized, the second ADC ADC2 detects a voltage level of the second node s through the third thin film transistor T3 and the fourth transistor S4, whereby the voltage threshold Vth of the first thin film transistor T1 and the intrinsic conductivity factor value k are detected.

Preferably, during the detecting phase t2 of the detecting mode: a first data current Idata1 is input to charge and discharge the second node s through the first TFT T1. The first ADC ADC1 detects the voltage level of the first node g through the second thin film transistor T2 and the sixth transistor S6 after the data current is stabilized. The second ADC ADC2 detects the voltage level of the second node s through the third thin film transistor T3 and the fourth transistor S4, whereby a first voltage difference Vgs1 between the gate and the source of the first TFT T1 is obtained. A second data current Idata2 is input to charge and discharge the second node s through the first TFT T1. The first ADC ADC1 detects the voltage level of the first node g through the second thin film transistor T2 and the sixth transistor S6 after the data current is stabilized. The second ADC ADC2 detects the voltage level of the second node s through the third thin film transistor T3 and the fourth transistor S4, whereby a second voltage difference Vgs2 between the gate and the source of the first TFT T1 is obtained. To solve the simultaneous equations of Idata1=k(Vgs1−Vth) and Idata2=k(Vgs2−Vth), the voltage threshold Vth of the first TFT T1 and the intrinsic conductivity factor value k are obtained, in which the Idata1 is the first data current, Vgs1 is the first voltage difference between the gate and the source of the first TFT, Idata2 is the second data current, Vgs2 is the second voltage difference between the gate and the source of the first TFT, Vth is the voltage threshold of the first thin film transistor, and k is the intrinsic conductivity factor value.

That is, when the first transistor S1 is on, the data current Idata charges and discharges the node s through the first TFT T1, the current finally flowed across the OLED is the data current Idata. At the time, the first ADC ADC1 detects the voltage level of the node g through the second TFT T2 and the sixth transistor S6, the second ADC ADC2 detects the voltage level of the node s through the third TFT T3 and the fourth transistor S4. And then, the data current Idata is varied to detect the voltage levels of the node g and node s again, to solve the simultaneous equations of Idata1=k(Vgs1−Vth) and Idata2=k(Vgs2−Vth), the value k and value Vth are obtained. Thus, the corresponding data compensation can be implemented under the displaying mode according to value k and value Vth.

The OLED pixel driving circuit of the present disclosure utilizes the circuit scheme of 3T1C. The normal displaying mode and detecting mode of the pixel driving circuit both include two phases by controlling the conductions of different transistors. And, the pixel driving circuit is capable of implementing corresponding data compensation under the displaying mode according to the detected voltage threshold Vth of the driving TFT and the intrinsic conductivity factor value k of the aged OLED, that is, the voltage threshold Vth of the driving TFT and the drift of the intrinsic conductivity factor value k of the aged OLED can be compensated under the displaying mode. This is capable of improving the uniformity of display and the illuminating efficiency.

In this embodiment, the first to sixth transistors S1-S6 are switching components. Control ends of the first transistor S1 and the second transistor S2 are configured to receive corresponding voltage level control signals SW1, SW2, first connecting points of the first transistor S1 and the second transistor S2 are shorted then electrically connected to the drain of the first thin film transistor T1, a second connecting point of the first transistor S1 is input by the data current Idata, a second connecting point of the second transistor S2 is input by the power voltage OVDD. Control ends of the third transistor S3 and the fourth transistor S4 are configured to receive corresponding voltage level control signals SW3, SW4, first connecting points of the third transistor S3 and the fourth transistor S4 are shorted then electrically connected to the drain of the third thin film transistor T3, a second connecting point of the third transistor S3 is input by the reference voltage Vref, a second connecting point of the fourth transistor is connected to the second ADC ADC2. Control ends of the fifth transistor S5 and the sixth transistor S6 are configured to receive corresponding voltage level control signals SW5, SW6, first connecting points of the fifth transistor S5 and the sixth transistor S6 are shorted then electrically connected to the drain of the second thin film transistor T2, a second connecting point of the fifth transistor S5 is input by the data voltage Vdata during the displaying mode and is input by the initializing voltage Vini during the detecting mode, a second connecting point of the sixth transistor S6 is connected to the first ADC ADC1.

Further, during the data writing t1 phase of the displaying mode, the scan signal Scan is in the high voltage level, the control ends of the first, fourth and sixth transistors S1, S4, S6 receive the low voltage level (i.e., the signals SW1, SW4 and SW6 are low voltage level signals), the control ends of the second, third and fifth transistors S2, S3, S5 receive the high voltage level (i.e., the signals SW2, SW3 and SW5 are high voltage level signals). During the illuminating phase t2 of the displaying mode, the scan signal Scan is in the low voltage level, the control ends of the first, fourth and sixth transistors S1, S4, S6 receive the low voltage level, the control ends of the second, third and fifth transistors S2, S3, S5 receive the high voltage level. Thus, during the displaying mode, the second, third and fifth transistors S2, S3, S5 are always on, and the first, fourth and sixth transistors S1, S4, S6 are always off.

Further, during the voltage level initializing phase t1 of the detecting mode, the scan signal Scan is in the high voltage level, the control ends of the first, second, fourth and sixth transistors S1, S2, S4, S6 receive the low voltage level, the control ends of the third and fifth transistors S3, S5 receive said high voltage level. During the detecting phase t2 of the detecting mode: the scan signal Scan is in the high voltage level, the control ends of the first, fourth and sixth transistors S1, S4, S6 receive the high voltage level, the control ends of the second, third and fifth transistors S2, S3, S5 receive the low voltage level.

Figure 6:
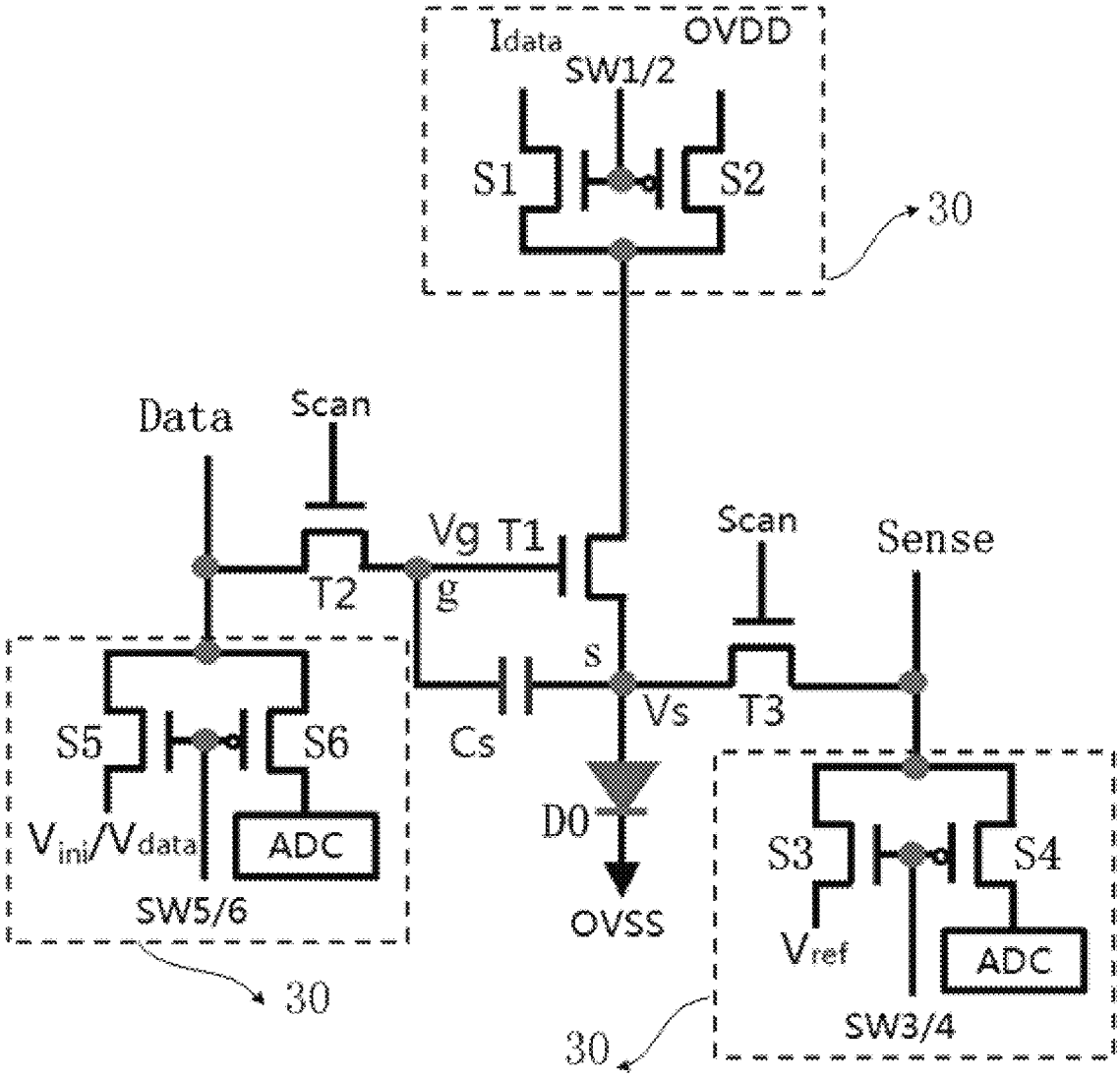
FIG. 6 a schematic view of a second embodiment of an OLED pixel driving circuit of the present disclosure.
Figure 7:
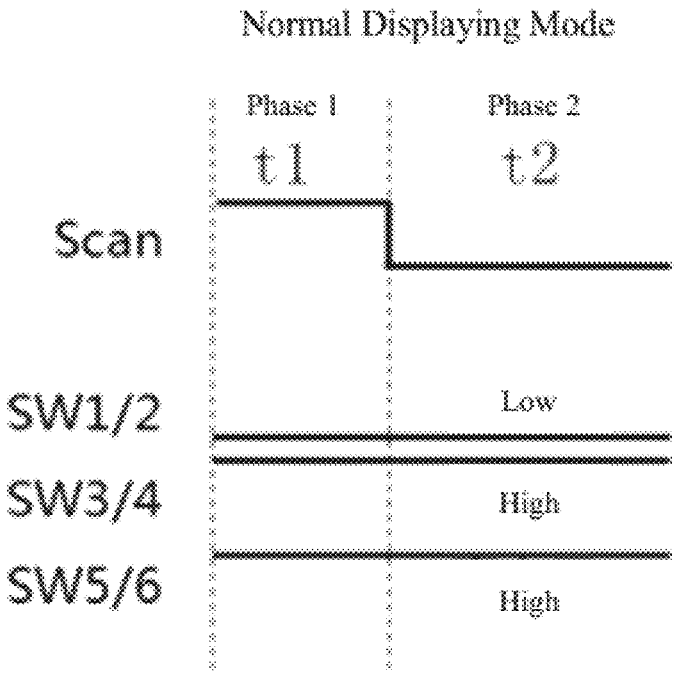
FIG. 7 is a timing diagram of a displaying mode of the OLED pixel driving circuit shown in FIG. 6.
Figure 8:
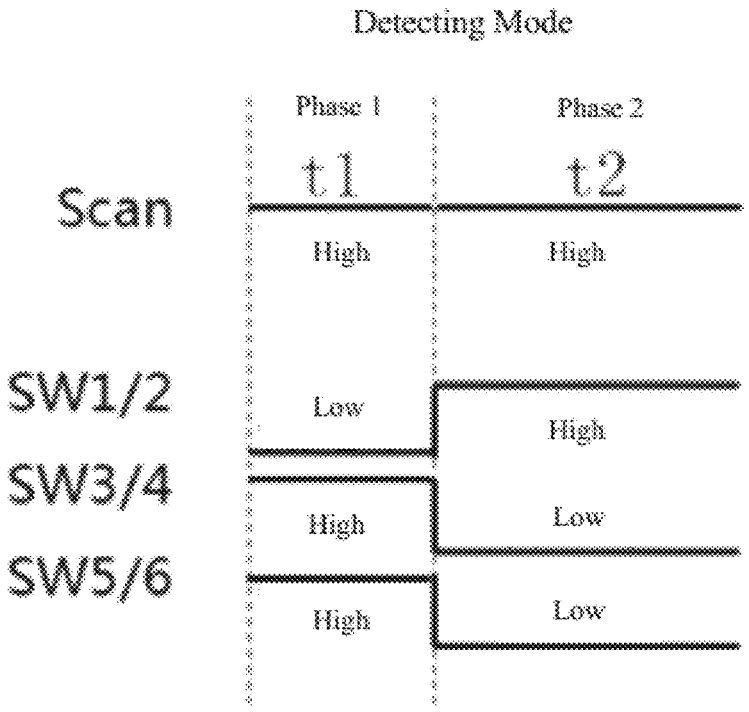
FIG. 8 is a timing diagram of a detecting mode of the OLED pixel driving circuit shown in FIG. 6.

Referring to FIGS. 6-8, FIG. 6 is a schematic view of a second embodiment of an OLED pixel driving circuit of the present disclosure, FIG. 7 is a timing diagram of a displaying mode of the OLED pixel driving circuit shown in FIG. 6, and FIG. 8 is a timing diagram of a detecting mode of the OLED pixel driving circuit shown in FIG. 6. In contrast to the embodiment shown in FIG. 3, the first to sixth transistors are all metal-oxide semiconductor (MOS) transistors. Gates of the first transistor S1 and the second transistor S2 are shorted to receive corresponding voltage level control signals SW1/2, sources of the first transistor S1 and the second transistor S2 are shorted and electrically connected to the drain of the first thin film transistor T1, a source of the first transistor S1 is input by the data current Idata, a source of the second transistor S2 is input by the power voltage OVDD. Gates of the third transistor S3 and the fourth transistor S4 are shorted to receive corresponding voltage level control signals SW3/4, sources of the third transistor S3 and the fourth transistor S4 are shorted and electrically connected to the drain of the third thin film transistor T3, a drain of the third transistor S3 is input by the reference voltage Vref, a drain of the fourth transistor S4 is connected to the second ADC ADC2. Gates of the fifth transistor S5 and the sixth transistor S6 are shorted to receive corresponding voltage level control signals SW5/6, sources of the fifth transistor S5 and the sixth transistor S6 are shorted and electrically connected to the drain of the second thin film transistor T2, a drain of the fifth transistor S5 is input by the data voltage Vdata during the displaying mode and is input by the initializing voltage Vini during the detecting mode, a drain of the sixth transistor is connected to the first ADC ADC1.

Further, during the data writing phase t1 of the displaying mode, the scan signal Scan is in the high voltage level, the gates of the first transistor S1 and the second transistor S2 receive the low voltage level (i.e., the signals SW1/2 are low voltage level signals), the gates of the third, fourth, fifth and sixth transistors S3, S4, S5, S6 receive the high voltage level (i.e., the signals SW3/4, SW5/6 are high voltage level signals). During the illuminating phase t2 of the displaying mode, the scan signal Scan is in the low voltage level, the gates of the first transistor S1 and the second transistor S2 receive the low voltage level, the gates of the third, fourth, fifth and sixth transistors receive the high voltage level. Thus, during the displaying mode, the second, third and fifth transistors S2, S3, S5 are always on, and the first, fourth and sixth transistors S1, S4, S6 are always off.

Further, during the voltage level initializing phase t1 of the detecting mode, the scan signal Scan is in the high voltage level. The gates of the first transistor S1 and the second transistor S2 receive the low voltage level. The gates of the third, fourth, fifth and sixth transistors S3, S4, S5, S6 receive the high voltage level. During the detecting phase t2 of the detecting mode, the scan signal Scan is in the high voltage level. The gates of the first transistor S1 and the second transistor S2 receive the high voltage level. The gates of the third, fourth, fifth and sixth transistors S3, S4, S5, S6 receive the low voltage level.

The present disclosure further provides an OLED display apparatus which includes above-mentioned OLED pixel driving circuit. The schemes and functions of the OLED pixel driving circuit are not reiterated here.

The OLEDpixel driving circuit and the OLED display apparatus of the present disclosure utilizes the circuit scheme of 3T1C. The normal displaying mode and detecting mode of the pixel driving circuit both include two phases by controlling the conductions of different transistors. Moreover, the pixel driving circuit is capable of implementing corresponding data compensation under the displaying mode according to the detected voltage threshold Vth of the driving TFT and the intrinsic conductivity factor value k of the aged OLED. This is capable of improving the uniformity of display and the illuminating efficiency.

The specific embodiments described herein are only for explaining the present disclosure. It should be noted that various changes and modifications can be made to the invention in light of the above detailed description by those skilled in the art, and those various changes and modifications should be considered to be pertained to the scope of the present invention.

What is claimed is:

1. An organic light emitting diode (OLED) pixel driving circuit having an operating status including a displaying mode and a detecting mode, said driving circuit comprising:

a first thin film transistor, a gate of said first thin film transistor electrically connecting with a first node, a source of said first thin film transistor electrically connecting with a second node, a drain of said first thin film transistor simultaneously electrically connected to a data current through a first transistor and electrically connected to a power voltage through a second transistor;

a second thin film transistor, a gate of said second thin film transistor electrically connected to a scan signal, a source of said second thin film transistor electrically connected to said first node, a drain of said second thin film transistor electrically connected to a data signal, electrically connected to a data voltage through a fifth transistor during said displaying mode, electrically connected to an initializing voltage through said fifth transistor during said detecting mode and electrically connected to a first analog to digital converter (ADC) through a sixth transistor;

a third thin film transistor, a gate of said third thin film transistor electrically connected to said scan signal, a source of said third thin film transistor electrically connected to said second node, a drain of said third thin film transistor simultaneously electrically connected to a reference voltage through a third transistor and a second ADC through a fourth transistor;

a capacitor, one end of said capacitor electrically connected to said first node, the other end of said capacitor electrically connected to said second node; and an OLED, an anode of said OLED electrically connected to said second node, a cathode of said OLED electrically connected to a common ground;

wherein said first to said sixth transistors, said first and second ADCs are disposed in a driver chip;

wherein said displaying mode comprises a data writing phase and an illuminating phase;

wherein during said data writing phase of said displaying mode, said scan signal is in a high voltage level so as to enable a conduction of said second thin film transistor and said third thin film transistor, said second transistor, said fifth transistor and said third transistor are conducted under control by corresponding voltage level control signals, said first node is written with said data voltage through said second thin film transistor and said fifth transistor, said second node is written with said reference voltage through said third thin film transistor and said third transistor;

wherein during said illuminating phase of said displaying mode, said scan signal is in a low voltage level so as to disable the conduction of said second thin film transistor and said third thin film transistor, charges stored in said capacitor are attributed to a difference between said data voltage and said reference voltage, and said OLED illuminates;

wherein said detecting mode comprises a voltage level initializing phase and a detecting phase;

wherein during said voltage level initializing phase of said detecting mode, said scan signal is in said high voltage level so as to enable the conduction of said second thin film transistor and said third thin film transistor, said fifth transistor and said third transistor are conducted under control by the corresponding voltage level control signal, said first node is written with said initializing voltage through said second thin film transistor and said fifth transistor, said second node is written with said reference voltage through said third thin film transistor and said third transistor; and wherein during said detecting phase of said detecting mode, said scan signal is in said high voltage level, said fifth transistor and said third transistor are cut off under control by the corresponding voltage level control signals, said first transistor, said sixth transistor and said fourth transistor are conducted under control by the corresponding voltage level control signals, said second node is charged and discharged by inputting different values of said data current through said first thin film transistor, said first ADC detects a voltage level of said first node through said second thin film transistor and said sixth transistor after said data current is stabilized, said second ADC detects a voltage level of said second node through said third thin film transistor and said fourth transistor, whereby a voltage threshold of said first thin film transistor and an intrinsic conductivity factor value are detected.

2. The driving circuit according to claim 1, wherein during said detecting phase of said detecting mode:

said second node is charged and discharged by inputting a first data current through said first thin film transistor, said first ADC detects said voltage level of said first node through said second thin film transistor and said sixth transistor after said first data current is stabilized, said second ADC detects said voltage level of said second node through said third thin film transistor and said fourth transistor, whereby a first voltage difference between said gate and said source of said first thin film transistor is obtained; and said second node is charged and discharged by inputting a second data current through said first thin film transistor, said first ADC detects said voltage level of said first node through said second thin film transistor and said sixth transistor after said second data current is stabilized, said second ADC detects said voltage level of said second node through said third thin film transistor and said fourth transistor, whereby a second voltage difference between said gate and said source of said first thin film transistor is obtained;

wherein said voltage threshold of said first thin film transistor and said intrinsic conductivity factor value are obtained according to the simultaneous equations of Idata1=k(Vgs1−Vth) and Idata2=k(Vgs2−Vth), in which Idata1 is said first data current, Vgs1 is said first voltage difference, Idata2 is said second data current, Vgs2 is said second voltage difference, Vth is said voltage threshold of said first thin film transistor, and k is said intrinsic conductivity factor value.

3. The driving circuit according to claim 1, wherein said first to said sixth transistors are switching components;

wherein control ends of said first transistor and said second transistor are configured to receive corresponding voltage level control signals, first connecting points of said first transistor and said second transistor are shorted and then electrically connected to said drain of said first thin film transistor, a second connecting point of said first transistor is input by said data current, a second connecting point of said second transistor is input by said power voltage, control ends of said third transistor and said fourth transistor are configured to receive corresponding voltage level control signals, first connecting points of said third transistor and said fourth transistor are shorted and then electrically connected to said drain of said third thin film transistor, a second connecting point of said third transistor is input by said reference voltage, and a second connecting point of said fourth transistor is connected to said second ADC; and wherein control ends of said fifth transistor and said sixth transistor are configured to receive corresponding voltage level control signals, first connecting points of said fifth transistor and said sixth transistor are shorted then electrically connected to said drain of said second thin film transistor, a second connecting point of said fifth transistor is input by said data voltage during said displaying mode and is input by said initializing voltage during said detecting mode, and a second connecting point of said sixth transistor is connected to said first ADC.

4. The driving circuit according to claim 3, wherein during said data writing phase of said displaying mode, said scan signal is in said high voltage level, said control ends of said first, said fourth and said sixth transistors receive said low voltage level, and said control ends of said second, said third and said fifth transistors receive said high voltage level;

wherein during said illuminating phase of said displaying mode, said scan signal is in said low voltage level, said control ends of said first, said fourth and said sixth transistors receive said low voltage level, and said control ends of said second, said third and said fifth transistors receive said high voltage level;

wherein during said voltage level initializing phase of said detecting mode, said scan signal is in said high voltage level, said control ends of said first, said second, said fourth and said sixth transistors receive said low voltage level, and said control ends of said third and said fifth transistors receive said high voltage level; and wherein during said detecting phase of said detecting mode, said scan signal is in said high voltage level, said control ends of said first, said fourth and said sixth transistors receive said high voltage level, and said control ends of said second, said third and said fifth transistors receive said low voltage level.

5. The driving circuit according to claim 1, wherein said first to said sixth transistors are metal oxide semiconductor field effect transistors (MOSFET);

wherein said gates of said first transistor and said second transistor are shorted to receive corresponding voltage level control signals, said sources of said first transistor and said second transistor are shorted and electrically connected to said drain of said first thin film transistor, said source of said first transistor is input by said data current, and said source of said second transistor is input by said power voltage;

wherein said gates of said third transistor and said fourth transistor are shorted to receive corresponding voltage level control signals, said sources of said third transistor and said fourth transistor are shorted and electrically connected to said drain of said third thin film transistor, said drain of said third transistor is input by said reference voltage, and said drain of said fourth transistor is connected to said second ADC; and wherein said gates of said fifth transistor and said sixth transistor are shorted to receive corresponding voltage level control signals, said sources of said fifth transistor and said sixth transistor are shorted and electrically connected to said drain of said second thin film transistor, said drain of said fifth transistor is input by said data voltage during said displaying mode and is input by said initializing voltage during said detecting mode, and said drain of said sixth transistor is connected to said first ADC.

6. The driving circuit according to claim 5, wherein during said data writing phase of said displaying mode, said scan signal is in said high voltage level, said gates of said first transistor and said second transistor receive said low voltage level, and said gates of said third, said fourth, said fifth and said sixth transistors receive said high voltage level;

wherein during said illuminating phase of said displaying mode, said scan signal is in said low voltage level, said gates of said first transistor and said second transistor receive said low voltage level, and said gates of said third, said fourth, said fifth and said sixth transistors receive said high voltage level;

wherein during said voltage level initializing phase of said detecting mode, said scan signal is in said high voltage level, said gates of said first transistor and said second transistor receive said low voltage level, and said gates of said third, said fourth, said fifth and said sixth transistors receive said high voltage level; and wherein during said detecting phase of said detecting mode, said scan signal is in said high voltage level, said gates of said first transistor and said second transistor receive said high voltage level, and said gates of said third, said fourth, said fifth and said sixth transistors receive said low voltage level.

7. An organic light emitting diode (OLED) pixel driving circuit comprising the operating status of a displaying mode and a detecting mode, said driving circuit comprising:

a first thin film transistor, a gate of said first thin film transistor electrically connected to a first node, a source of said first thin film transistor electrically connected to a second node, a drain of said first thin film transistor electrically connected to a data current through a first transistor and electrically connected to a power voltage through a second transistor;

a second thin film transistor, a gate of said second thin film transistor electrically connected to a scan signal, a source of said second thin film transistor electrically connected to said first node, a drain of said second thin film transistor electrically connected to a data signal, electrically connected to a data voltage through a fifth transistor during said displaying mode, electrically connected to a initializing voltage through said fifth transistor during said detecting mode and electrically connected to a first analog to digital converter (ADC) through a sixth transistor;

a third thin film transistor, a gate of said third thin film transistor electrically connected to said scan signal, a source of said third thin film transistor electrically connected to said second node, a drain of said third thin film transistor simultaneously electrically connected to a reference voltage through a third transistor and a second ADC through a fourth transistor;

a capacitor, one end of said capacitor electrically connected to said first node, the other end of said capacitor electrically connected to said second node; and an OLED, an anode of said OLED electrically connected to said second node, a cathode of said OLED electrically connected to a common ground;

wherein during said displaying mode, said second transistor, said fifth transistor and said third transistor are conducted under control by the corresponding voltage level control signals;

wherein said displaying mode comprises a data writing phase and an illuminating phase, said scan signal is in a high voltage level during said data writing phase so as to enable the conductions of said second thin film transistor and said third thin film transistor, said data voltage and said reference voltage are input into said driving circuit, said scan signal is in a low voltage level during said illuminating phase so as to disable the conductions of said second thin film transistor and said third thin film transistor, the charges stored in said capacitor illuminate said OLED;

wherein during said detecting mode, said fifth transistor and said third transistor are conducted under control by the corresponding voltage level control signals in the first, and then said fifth transistor and said third transistor are cut off under control by the corresponding voltage level control signals, and, said first transistor, said sixth transistor and said fourth transistor are conducted under control by the corresponding voltage level control signals;

wherein said detecting mode comprises a voltage level initializing phase and a detecting phase, said scan signal is always in said high voltage level, said second thin film transistor and said third thin film transistor are conducted during said voltage level initializing phase, said initializing voltage and said reference voltage are input into said driving circuit, said data current is input into said driving circuit during said detecting mode, said first ADC and said second ADC detect a voltage threshold of said first thin film transistor and an intrinsic conductivity factor value by inputting different values of said data current.

8. The driving circuit according to claim 7, wherein during said data writing phase of said displaying mode: said scan signal is in said high voltage level so as to enable the conductions of said second thin film transistor and said third thin film transistor, said second transistor, said fifth transistor and said third transistor are conducted under control by the corresponding voltage level control signals, said first node is written with said data voltage through said second thin film transistor and said fifth transistor, said second node is written with said reference voltage through said third thin film transistor and said third transistor;

wherein during said illuminating phase of said displaying mode: said scan signal is in said low voltage level so as to disable the conductions of said second thin film transistor and said third thin film transistor, the charges stored in said capacitor are attributed to a difference between said data voltage and said reference voltage, and said OLED illuminates;

wherein during said voltage level initializing phase of said detecting mode, said scan signal is in said high voltage level so as to enable the conductions of said second thin film transistor and said third thin film transistor, said fifth transistor and said third transistor are conducted under control by the corresponding voltage level control signals, said first node is written with said initializing voltage through said second thin film transistor and said fifth transistor, said second node is written with said reference voltage through said third thin film transistor and said third transistor;

wherein during said detecting phase of said detecting mode: said scan signal is in said high voltage level, said fifth transistor and said third transistor are cut off under control by the corresponding voltage level control signals, said first transistor, said sixth transistor and said fourth transistor are conducted under control by the corresponding voltage level control signals, said second node is charged and discharged by inputting different values of said data current through said first thin film transistor, said first ADC detects a voltage level of said first node through said second thin film transistor and said sixth transistor after said data current is stabilized, said second ADC detects a voltage level of said second node through said third thin film transistor and said fourth transistor, whereby said voltage threshold of said first thin film transistor and said intrinsic conductivity factor value are detected.

9. The driving circuit according to claim 8, wherein during said detecting phase of said detecting mode: said second node is charged and discharged by inputting a first data current through said first thin film transistor, said first ADC detects said voltage level of said first node through said second thin film transistor and said sixth transistor after said first data current is stabilized, said second ADC detects said voltage level of said second node through said third thin film transistor and said fourth transistor, whereby a first voltage difference between said gate and said source of said first thin film transistor is obtained; and said second node is charged and discharged by inputting a second data current through said first thin film transistor, said first ADC detects said voltage level of said first node through said second thin film transistor and said sixth transistor after said second data current is stabilized, said second ADC detects said voltage level of said second node through said third thin film transistor and said fourth transistor, whereby a second voltage difference between said gate and said source of said first thin film transistor is obtained;

wherein said voltage threshold of said first thin film transistor and said intrinsic conductivity factor value are obtained according to the simultaneous equations of $Idata1=k(Vgs1-Vth)$ and $Idata2=k(Vgs2-Vth)$, in which Idata1 is said first data current, Vgs1 is said first voltage difference, Idata2 is said second data current, Vgs2 is said second voltage difference, Vth is said voltage threshold of said first thin film transistor, and k is said intrinsic conductivity factor value.

10. The driving circuit according to claim 7, wherein said first to said sixth transistors are switching components;

wherein the control ends of said first transistor and said second transistor are configured to receive corresponding voltage level control signals, the first connecting points of said first transistor and said second transistor are shorted then electrically connected to said drain of said first thin film transistor, a second connecting point of said first transistor is input by said data current, a second connecting point of said second transistor is input by said power voltage, the control ends of said third transistor and said fourth transistor are configured to receive corresponding voltage level control signals, the first connecting points of said third transistor and said fourth transistor are shorted then electrically connected to said drain of said third thin film transistor, a second connecting point of said third transistor is input by said reference voltage, a second connecting point of said fourth transistor is connected to said second ADC;

wherein the control ends of said fifth transistor and said sixth transistor are configured to receive corresponding voltage level control signals, the first connecting points of said fifth transistor and said sixth transistor are shorted then electrically connected to said drain of said second thin film transistor, a second connecting point of said fifth transistor is input by said data voltage during said displaying mode and is input by said initializing voltage during said detecting mode, a second connecting point of said sixth transistor is connected to said first ADC.

11. The driving circuit according to claim 10, wherein during said data writing phase of said displaying mode: said scan signal is in said high voltage level, said control ends of said first, said fourth and said sixth transistors receive said low voltage level, said control ends of said second, said third and said fifth transistors receive said high voltage level;

wherein during said illuminating phase of said displaying mode: said scan signal is in said low voltage level, said control ends of said first, said fourth and said sixth transistors receive said low voltage level, said control ends of said second, said third and said fifth transistors receive said high voltage level;

wherein during said voltage level initializing phase of said detecting mode: said scan signal is in said high voltage level, said control ends of said first, said second, said fourth and said sixth transistors receive said low voltage level, said control ends of said third and said fifth transistors receive said high voltage level;

wherein during said detecting phase of said detecting mode: said scan signal is in said high voltage level, said control ends of said first, said fourth and said sixth transistors receive said high voltage level, said control ends of said second, said third and said fifth transistors receive said low voltage level.

12. The driving circuit according to claim 7, wherein said first to said sixth transistors are metal oxide semiconductor field effect transistors (MOSFET);

wherein said gates of said first transistor and said second transistor are shorted to receive corresponding voltage level control signals, said sources of said first transistor and said second transistor are shorted and electrically connected to said drain of said first thin film transistor, said source of said first transistor is input by said data current, said source of said second transistor is input by said power voltage;

wherein said gates of said third transistor and said fourth transistor are shorted to receive corresponding voltage level control signals, said sources of said third transistor and said fourth transistor are shorted and electrically connected to said drain of said third thin film transistor, said drain of said third transistor is input by said reference voltage, said drain of said fourth transistor is connected to said second ADC;

wherein said gates of said fifth transistor and said sixth transistor are shorted to receive corresponding voltage level control signals, said sources of said fifth transistor and said sixth transistor are shorted and electrically connected to said drain of said second thin film transistor, said drain of said fifth transistor is input by said data voltage during said displaying mode and is input by said initializing voltage during said detecting mode, said drain of said sixth transistor is connected to said first ADC.

13. The driving circuit according to claim 12, wherein during said data writing phase of said displaying mode: said scan signal is in said high voltage level, said gates of said first transistor and said second transistor receive said low voltage level, said gates of said third, said fourth, said fifth and said sixth transistors receive said high voltage level;

wherein during said illuminating phase of said displaying mode: said scan signal is in said low voltage level, said gates of said first transistor and said second transistor receive said low voltage level, said gates of said third, said fourth, said fifth and said sixth transistors receive said high voltage level;

wherein during said voltage level initializing phase of said detecting mode: said scan signal is in said high voltage level, said gates of said first transistor and said second transistor receive said low voltage level, said gates of said third, said fourth, said fifth and said sixth transistors receive said high voltage level;

wherein during said detecting phase of said detecting mode: said scan signal is in said high voltage level, said gates of said first transistor and said second transistor receive said high voltage level, said gates of said third, said fourth, said fifth and said sixth transistors receive said low voltage level.

14. The driving circuit according to claim 7, wherein said first to said sixth transistors, said first and second ADCs are disposed in a driver chip.

15. An organic light emitting diode (OLED) display apparatus comprising an OLED pixel driving circuit, wherein an operating status of said driving circuit comprises a displaying mode and a detecting mode, said driving circuit comprising:

a first thin film transistor, a gate of said first thin film transistor electrically connected to a first node, a source of said first thin film transistor electrically connected to a second node, a drain of said first thin film transistor electrically connected to a data current through a first transistor and electrically connected to a power voltage through a second transistor;

a second thin film transistor, a gate of said second thin film transistor electrically connected to a scan signal, a source of said second thin film transistor electrically connected to said first node, a drain of said second thin film transistor electrically connected to a data signal, electrically connected to a data voltage through a fifth transistor during said displaying mode, electrically connected to a initializing voltage through said fifth transistor during said detecting mode and electrically connected to a first analog to digital converter (ADC) through a sixth transistor;

a third thin film transistor, a gate of said third thin film transistor electrically connected to said scan signal, a source of said third thin film transistor electrically connected to said second node, a drain of said third thin film transistor simultaneously electrically connected to a reference voltage through a third transistor and a second ADC through a fourth transistor;

a capacitor, one end of said capacitor electrically connected to said first node, the other end of said capacitor electrically connected to said second node; and an OLED, an anode of said OLED electrically connected to said second node, a cathode of said OLED electrically connected to a common ground;

wherein said first to said sixth transistors, said first and second ADCs are disposed in a driver chip;

wherein said displaying mode comprises a data writing phase and an illuminating phase;

wherein during said data writing phase of said displaying mode, said scan signal is in a high voltage level so as to enable the conductions of said second thin film transistor and said third thin film transistor, said second transistor, said fifth transistor and said third transistor are conducted under control by the corresponding voltage level control signals, said first node is written with said data voltage through said second thin film transistor and said fifth transistor, said second node is written with said reference voltage through said third thin film transistor and said third transistor;

wherein during said illuminating phase of said displaying mode, said scan signal is in a low voltage level so as to disable the conductions of said second thin film transistor and said third thin film transistor, charges stored in said capacitor are attributed to a difference between said data voltage and said reference voltage, and said OLED illuminates;

wherein said detecting mode comprises a voltage level initializing phase and a detecting phase;

wherein during said voltage level initializing phase of said detecting mode: said scan signal is in said high voltage level so as to enable the conductions of said second thin film transistor and said third thin film transistor, said fifth transistor and said third transistor are conducted under control by the corresponding voltage level control signals, said first node is written with said initializing voltage through said second thin film transistor and said fifth transistor, said second node is written with said reference voltage through said third thin film transistor and said third transistor;

wherein during said detecting phase of said detecting mode: said scan signal is in said high voltage level, said fifth transistor and said third transistor are cut off under control by the corresponding voltage level control signals, said first transistor, said sixth transistor and said fourth transistor are conducted under control by the corresponding voltage level control signals, said second node is charged and discharged by inputting different values of said data current through said first thin film transistor, said first ADC detects a voltage level of said first node through said second thin film transistor and said sixth transistor after said data current is stabilized, said second ADC detects a voltage level of said second node through said third thin film transistor and said fourth transistor, whereby a voltage threshold of said first thin film transistor and an intrinsic conductivity factor value are detected.

16. The display apparatus according to claim 15, wherein during said detecting phase of said detecting mode: said second node is charged and discharged by inputting a first data current through said first thin film transistor, said first ADC detects said voltage level of said first node through said second thin film transistor and said sixth transistor after said first data current is stabilized, said second ADC detects said voltage level of said second node through said third thin film transistor and said fourth transistor, whereby a first voltage difference between said gate and said source of said first thin film transistor is obtained; and said second node is charged and discharged by inputting a second data current through said first thin film transistor, said first ADC detects said voltage level of said first node through said second thin film transistor and said sixth transistor after said second data current is stabilized, said second ADC detects said voltage level of said second node through said third thin film transistor and said fourth transistor, whereby a second voltage difference between said gate and said source of said first thin film transistor is obtained;

wherein said voltage threshold of said first thin film transistor and said intrinsic conductivity factor value is obtained according to the simultaneous equations of Idata1=k(Vgs1−Vth) and Idata2=k(Vgs2−Vth), in which Idata1 is said first data current, Vgs1 is said first voltage difference, Idata2 is said second data current, Vgs2 is said second voltage difference, Vth is said voltage threshold of said first thin film transistor, and k is said intrinsic conductivity factor value.

17. The display apparatus according to claim 15, wherein said first to said sixth transistors are switching components;

wherein the control ends of said first transistor and said second transistor are configured to receive corresponding voltage level control signals, the first connecting points of said first transistor and said second transistor are shorted then electrically connected to said drain of said first thin film transistor, a second connecting point of said first transistor is input by said data current, a second connecting point of said second transistor is input by said power voltage, the control ends of said third transistor and said fourth transistor are configured to receive corresponding voltage level control signals, the first connecting points of said third transistor and said fourth transistor are shorted then electrically connected to said drain of said third thin film transistor, a second connecting point of said third transistor is input by said reference voltage, a second connecting point of said fourth transistor is connected to said second ADC;

wherein the control ends of said fifth transistor and said sixth transistor are configured to receive corresponding voltage level control signals, the first connecting points of said fifth transistor and said sixth transistor are shorted then electrically connected to said drain of said second thin film transistor, a second connecting point of said fifth transistor is input by said data voltage during said displaying mode and is input by said initializing voltage during said detecting mode, a second connecting point of said sixth transistor is connected to said first ADC.

18. The display apparatus according to claim 17, wherein during said data writing phase of said displaying mode: said scan signal is in said high voltage level, said control ends of said first, said fourth and said sixth transistors receive said low voltage level, said control ends of said second, said third and said fifth transistors receive said high voltage level;

wherein during said illuminating phase of said displaying mode: said scan signal is in said low voltage level, said control ends of said first, said fourth and said sixth transistors receive said low voltage level, said control ends of said second, said third and said fifth transistors receive said high voltage level;

wherein during said voltage level initializing phase of said detecting mode: said scan signal is in said high voltage level, said control ends of said first, said second, said fourth and said sixth transistors receive said low voltage level, said control ends of said third and said fifth transistors receive said high voltage level;

wherein during said detecting phase of said detecting mode: said scan signal is in said high voltage level, said control ends of said first, said fourth and said sixth transistors receive said high voltage level, said control ends of said second, said third and said fifth transistors receive said low voltage level.

19. The display apparatus according to claim 15, wherein said first to said sixth transistors are metal oxide semiconductor field effect transistors (MOSFET);

wherein said gates of said first transistor and said second transistor are shorted to receive corresponding voltage level control signals, said sources of said first transistor and said second transistor are shorted and electrically connected to said drain of said first thin film transistor, said source of said first transistor is input by said data current, said source of said second transistor is input by said power voltage;

wherein said gates of said third transistor and said fourth transistor are shorted to receive corresponding voltage level control signals, said sources of said third transistor and said fourth transistor are shorted and electrically connected to said drain of said third thin film transistor, said drain of said third transistor is input by said reference voltage, said drain of said fourth transistor is connected to said second ADC;

wherein said gates of said fifth transistor and said sixth transistor are shorted to receive corresponding voltage level control signals, said sources of said fifth transistor and said sixth transistor are shorted and electrically connected to said drain of said second thin film transistor, said drain of said fifth transistor is input by said data voltage during said displaying mode and is input by said initializing voltage during said detecting mode, said drain of said sixth transistor is connected to said first ADC.

20. The display apparatus according to claim 19, wherein during said data writing phase of said displaying mode: said scan signal is in said high voltage level, said gates of said first transistor and said second transistor receive said low voltage level, said gates of said third, said fourth, said fifth and said sixth transistors receive said high voltage level;

wherein during said illuminating phase of said displaying mode: said scan signal is in said low voltage level, said gates of said first transistor and said second transistor receive said low voltage level, said gates of said third, said fourth, said fifth and said sixth transistors receive said high voltage level;

wherein during said voltage level initializing phase of said detecting mode: said scan signal is in said high voltage level, said gates of said first transistor and said second transistor receive said low voltage level, said gates of said third, said fourth, said fifth and said sixth transistors receive said high voltage level;

wherein during said detecting phase of said detecting mode: said scan signal is in said high voltage level, said gates of said first transistor and said second transistor receive said high voltage level, said gates of said third, said fourth, said fifth and said sixth transistors receive said low voltage level.

* * * * *